US008552866B2

(12) United States Patent
Pokrajac et al.

(10) Patent No.: US 8,552,866 B2
(45) Date of Patent: Oct. 8, 2013

(54) METHOD AND SYSTEM FOR DETERMINING RFID TAG TAMPERING

(76) Inventors: Dalibor Pokrajac, Coquitlam (CA); Chris Chattaway, Surrey (CA); Bazlul Karim, Richmond (CA); Al-Karim Walji, Ladner (CA)

( * ) Notice: Subject to any disclaimer, the term of this patent is extended or adjusted under 35 U.S.C. 154(b) by 584 days.

(21) Appl. No.: 12/663,705

(22) PCT Filed: Jun. 9, 2008

(86) PCT No.: PCT/CA2008/001108

§ 371 (c)(1),
(2), (4) Date: Dec. 8, 2009

(87) PCT Pub. No.: WO2008/148220

PCT Pub. Date: Dec. 11, 2008

(65) Prior Publication Data

US 2010/0207769 A1 Aug. 19, 2010

Related U.S. Application Data

(60) Provisional application No. 60/942,892, filed on Jun. 8, 2007, provisional application No. 60/942,901, filed on Jun. 8, 2007.

(51) Int. Cl.
*G08B 13/14* (2006.01)

(52) U.S. Cl.
USPC ..... 340/572.1; 340/600; 340/10.1

(58) Field of Classification Search
USPC ..... 340/600, 572.1
See application file for complete search history.

(56) References Cited

U.S. PATENT DOCUMENTS

| | | | | |
|---|---|---|---|---|
| 5,117,222 | A | 5/1992 | McCurdy | |
| 5,374,921 | A | 12/1994 | Martin | |
| 5,471,197 | A | 11/1995 | McCurdy | |
| 5,523,740 | A * | 6/1996 | Burgmann | 340/573.4 |
| 5,543,780 | A | 8/1996 | McAuley | |
| 5,650,766 | A | 7/1997 | Burgmann | |
| 6,169,494 | B1 * | 1/2001 | Lopes | 340/8.1 |
| 7,636,047 | B1 * | 12/2009 | Sempek | 340/572.8 |
| 2003/0174059 | A1 | 9/2003 | Reeves | |
| 2004/0208600 | A1 * | 10/2004 | Guenter et al. | 398/135 |
| 2005/0184870 | A1 | 8/2005 | Galperin | |
| 2007/0023496 | A1 * | 2/2007 | Hall | 235/375 |
| 2008/0076972 | A1 * | 3/2008 | Dorogusker et al. | 600/300 |
| 2008/0117022 | A1 * | 5/2008 | Polozola | 340/10.1 |

FOREIGN PATENT DOCUMENTS

| | | |
|---|---|---|
| EP | 1363258 | 11/2003 |

* cited by examiner

*Primary Examiner* — Kerri McNally

(57) ABSTRACT

The invention provides an RFID tag with means for determining when such tag has been tampered and means for securing the tag to an object. The tag may use an optical or infrared transmitter/receiver pair for detecting active tag removal from the object to which it is attached; and a method of attaching the tag holder to rounded objects regardless of object diameter while still preserving tamper capability of the active tag. Alternatively the tag may use an infrared radiation sensor to determine a change infrared radiation that occurs when the tag is removed from a person, and a light sensor to determine when tag has been tampered.

11 Claims, 11 Drawing Sheets

METHOD AND SYSTEM FOR DETERMINING RFID TAG TAMPERING

RELATED APPLICATIONS

This application claims the benefit of U.S. Provisional Applications Nos. 60/942,901 and 60/942,892, both of which were filed Jun. 8, 2007, and both of which are hereby incorporated by reference.

Field of the Invention

The present invention relates to the use of radio frequency identification ("RFID") tags to track people and objects, and more particularly to determining when such a tag, after being placed on a person or object, has been tampered.

BACKGROUND OF THE INVENTION

Active RFID tags can be used to provide perimeter protection. Patients and objects with active RFID tags may be unable to leave such a protected perimeter because a system can detect the presence of the tag and prevent a person bearing the tag from exiting the perimeter (for example, by engaging door locks and employing audio-visual alarms). For such applications, it is important to ensure that the tag cannot be removed from the patient or object without the system detecting such removal. It is also important to provide that tags can be secured to objects having unusual shapes, for example objects that do not have a flat surface.

There are available methods to address the removal of an active RFID tag from a patient. Two such methods are cut-band technology and capacitance sensing technology.

An example of tamper detection based on band conductivity is cut-band technology, which uses an electrically conductive band to secure a tag to a person's wrist, ankle or calf. The tag monitors whether the band is severed by detecting the resistance between two electrodes that are connected by the conductive band. There are several limitations to cut-band technology, for example it is difficult and expensive to manufacture a tag employing the technology, and it is relatively easy to remove such a tag, including the band, from a person's wrist or ankle without cutting the band. Therefore such a removal would not trigger a message that the tag has been tampered. This risk may be of particular concern if the tag is being used to monitor a newborn infant that happens to lose weight after birth. The use of cut-band technology may also result in false alarms due to inconsistencies in the ability to reliably detect the attachment of the band to the tag. Also, cut-band technology can be defeated by bypassing the band using a conductor with alligator clips on both ends.

Capacitance sensing technology includes a sensor within a tag capable of detecting a change in capacitance when it is either placed on a patient's body, or removed away from the body. This technology has several limitations, including that the change in capacitance is very small, and therefore may give rise to false alarms when the tag is not in proper contact with the person. It is also difficult and expensive to manufacture a tag with the capability of consistently detecting such small changes in capacitance.

Another solution available, for determining tampering of tags placed on objects, is the use of a mechanical solution in a form of a metal pin, protruding through the bottom of the tag enclosure, which opens or closes an electrical contact within the tag whenever it is removed or placed on the object.

A further problem with some of prior art tag tamper-detection methods are that they do not allow the tag enclosures to be fully sealed, because of the connectivity requirements between the internal tag electronics and any external sensors.

An existing solution to the problem of attaching active RFID tags (or tag holders) to surfaces include applying double-sided tape to keep the tag attached the object.

SUMMARY OF THE INVENTION

This proposal addresses a new method of detecting when a tag is attached to a person and when it is removed.

An RFID tag is provided, including a wireless network interface; a processor; a power supply; and an infrared radiation sensor, the radiation sensor sensitive to changes in infrared radiation; wherein the tag signals an alarm condition when the infrared radiation sensor senses a change in infrared radiation over a predetermined level. The change in radiation may have to occur in less than a predetermined time for the tag to signal an alarm condition. The tag may also include a light sensor and be covered by a light blocking material such that when the RFID tag is removed from a person, or a wrap positioning the tag is lifted away from the person, the light sensor is exposed to light and a tamper condition is signalled by the tag.

The tag may be positioned within a tag holder, and the tag holder positioned within an elongated wrap having a first side having a hook connection and a second side having a loop connection, such that the wrap can be positioned around a body part and held in place with a hook and loop connection.

The tag holder may be positioned within an elongated cylindrical sock, the sock positionable around a body part. Alternatively, the tag holder may have first and second slots for receiving a band to secure the tag holder to a body part.

The tag may be inactive until placed on a person's body wherein the change in infrared radiation is detected by the infrared sensor and the tag initiated. The tag may be activated by after it is initiated and the optical sensor does not detect light within a predetermined time period after initiation.

An RFID tag is provided, including a wireless network interface; a processor; a power supply; and an optical transmitter paired with an optical receiver, wherein when the optical receiver does not receive light emitted from the optical transmitter, a tamper alarm is signalled by the tag. The optical transmitter and optical receiver are not active unless activated by the processor or a timer. A reflective label placed on an object may be used to reflect light from the transmitter to the receiver. The tag my be positioned within a tag holder adhered to the reflective label, and if the object is curved, the tag may be mounted to the object using first and second flaps to adhere the tag to the object.

An RFID tag is provided, including a wireless network interface; a processor; a power supply; and an infrared transmitter paired with an infrared receiver, wherein when the infrared receiver does not receive an infrared signal emitted from the infrared transmitter, a tamper alarm is signalled by the tag. The infrared transmitter and infrared receiver are not active unless activated by the processor or a timer. A reflective label placed on an object may be used to reflect the infrared signal from the transmitter to the receiver. The tag my be positioned within a tag holder adhered to the reflective label, and if the object is curved, the tag may be mounted to the object using first and second flaps to adhere the tag to the object.

DESCRIPTION OF THE FIGURES

The following figures set forth embodiments of the invention in which like reference numerals denote like parts.

Embodiments of the invention are illustrated by way of example and not by way of limitation in the accompanying figures.

DETAILED DESCRIPTION OF THE INVENTION

Figure 1:
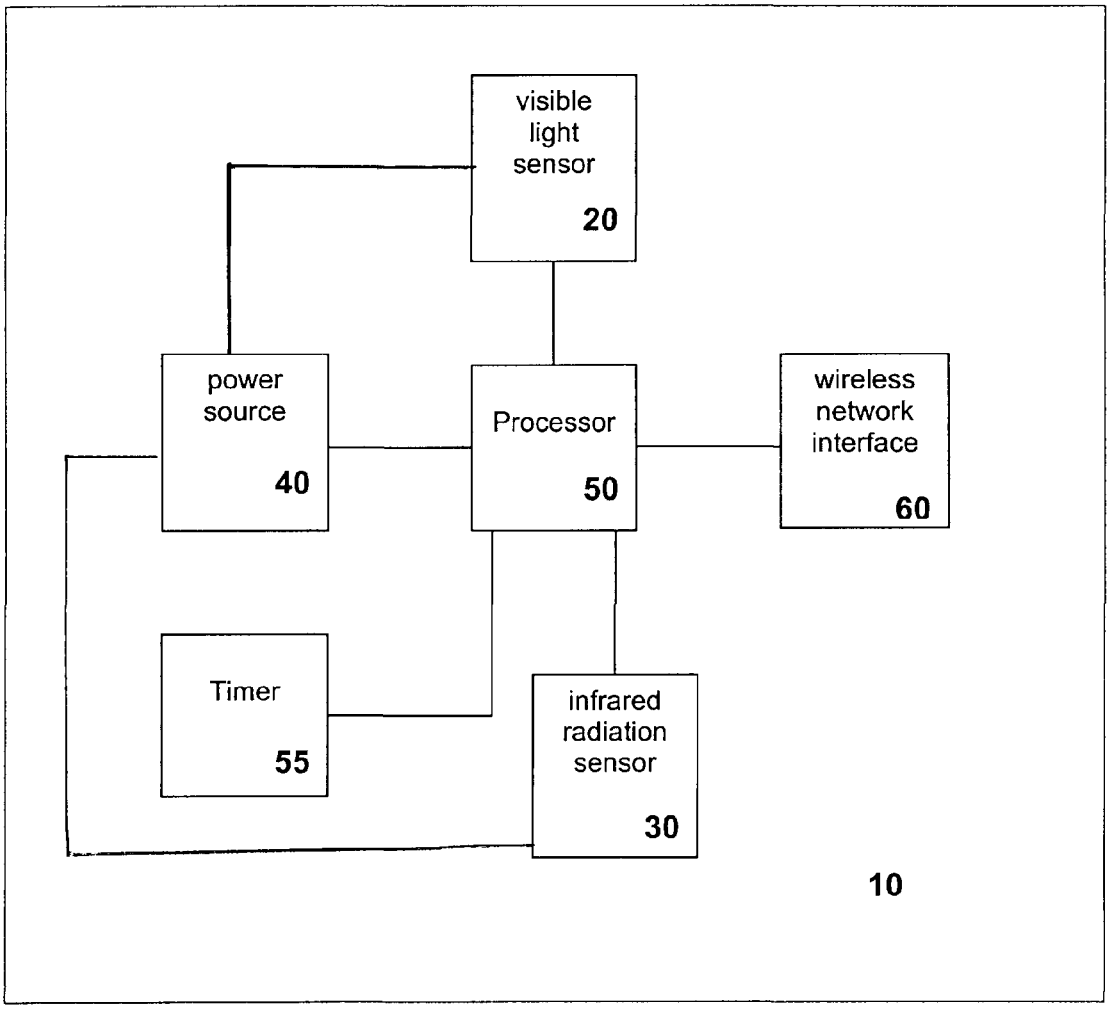
FIG. 1 is a block diagram of a tag according to an embodiment of the invention.

As seen in FIG. 1, in a first embodiment of the invention, meant for use with a person, RFID tag 10 includes visible light sensor 20 and infrared radiation sensor 30. Tag 10 also includes power source 40 to power sensors 20, 30 and processor 50. Processor 50 communicates to a system monitoring the tag through wireless network interface 60. Timer 55 may also be present on tag 10. Light sensor 20 is used to detect removal of a wrap or band maintaining the tag in place, and infrared radiation sensor 30 is used to detect the presence of a person's body. There are therefore, two independent mechanisms on tag 10 to determine if tag 10 has been removed from a person.

RFID tag 10 is placed on the person's body (for example, at the wrist, ankle, calf or similar location). Tag 10 is enclosed by enclosure 70, the bottom of which is made of a material which is transparent to both visible light and infrared radiation, such as Polly2-IR, made of high density polyethylene (HDPE). The top portion of enclosure 70 is opaque.

Figure 2A:
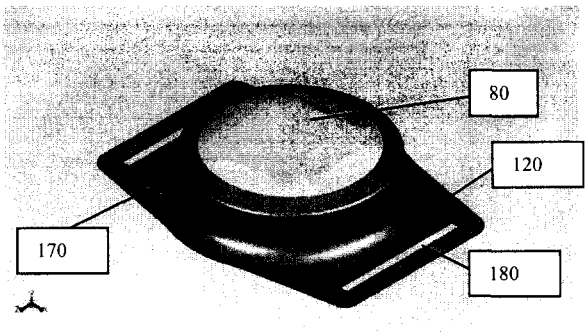
FIG. 2*a* is a perspective view of a tag inserted into a tag holder according to the invention.
Figure 2B:
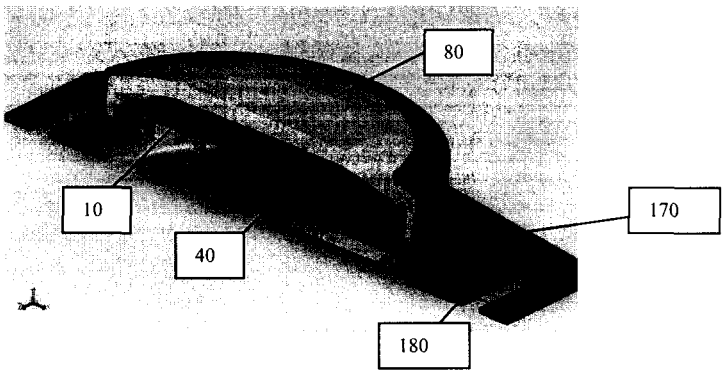
FIG. 2*b* is a perspective cutaway view thereof.

The top of tag 10 is covered by cover 80, which is made of flexible material that prevents visible ambient light detection by the visible light sensor 20. The opaque top of enclosure 70, tag holder 120 (often made of a soft rubber, preferably without latex, such as thermoplastic polyurethane) and strap 190 prevent visible light from entering enclosure 70. As seen in FIGS. 2*a* and 2*b*, tag holder 120 has two flaps 170 with slits 180 for receiving strap 190 used to attach tag 10 to the person. Each end of strap 190 can be tied together or otherwise connected using, for example, a belt loop assembly.

Figure 12:
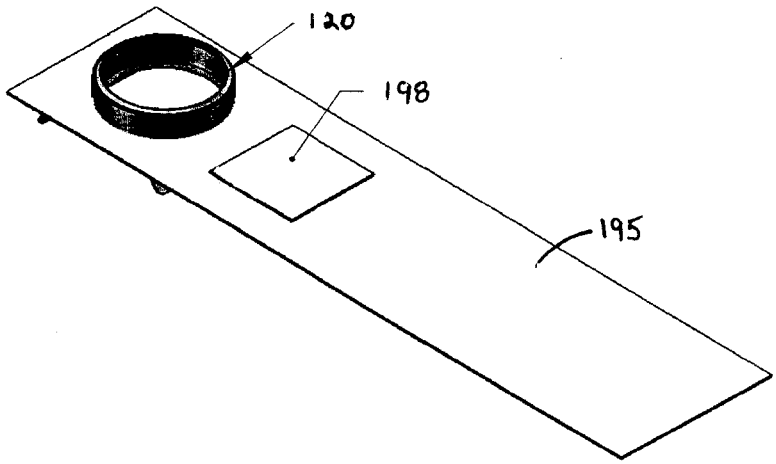
FIG. 12 is a top perspective view of a tag holder securable to a person using a wrap.
Figure 13:
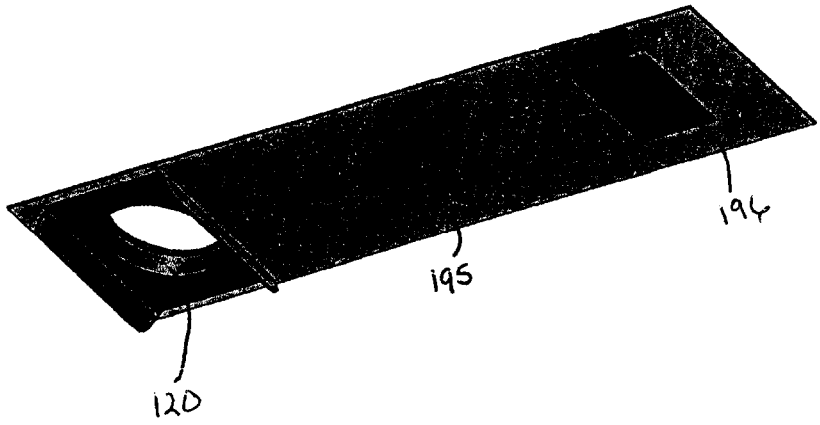
FIG. 13 is a bottom perspective view thereof.

In an alternative embodiment, as seen in FIGS. 12 and 13, a wrap 195 can be used to maintain the tag to a person. When used with wrap 195, tag 10 is enclosed in tag holder 120 and covered by wrap 195. Wrap 195 may be made of elastic material and wrapped around a person's body part, such as a calf, ankle, or arm. If tag 10 is removed from a person or object, tag cover 80 is removed from tag 10. Tag cover 80 may be part of tag holder 120. Tag cover 80 or wrap 195 or strap 190 may be removed by cutting off strap 190 or wrap 195, respectively, or separating the hook and loop connection from the male portion 196 and female portion 198 of wrap 195. These actions uncover tag 10 and expose light sensor 20 to light as tag 10 is lifted. The ambient light is then detected by light sensor 20, which is transmitted by processor 50 as a potential tamper alarm condition. Visible light sensor 20 may not trigger an instant tamper alarm condition, and may initially only trigger a warning. If the warning persists for predetermined period of time (e.g. light sensor 20 is exposed to light for such time) the warning condition becomes an alarm condition. Visible light sensor 20 can detect visible light if strap 190 or wrap 195 is removed from tag 10 or just partially uncovered, or if rubber tag holder 120 is pulled from the side of tag 10 so the visible light can enter enclosure 70 (from the enclosure sides or bottom). If tag 10 is lifted away from a person's body it will trigger an alarm condition due to infrared radiation sensor 30 detecting a change in infrared radiation as described below.

Figure 2C:
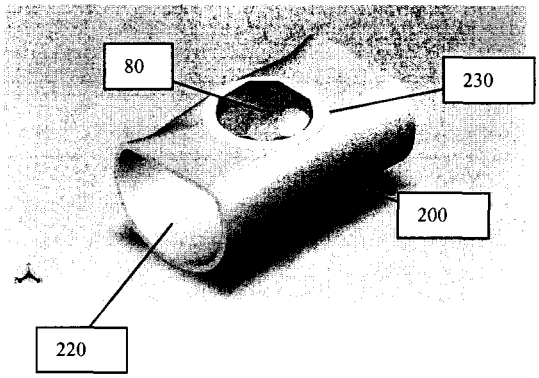
FIGS. 2*c* through 2*e* are perspective, front and cutaway view of alternative tag holders according to the invention.
Figure 2D:
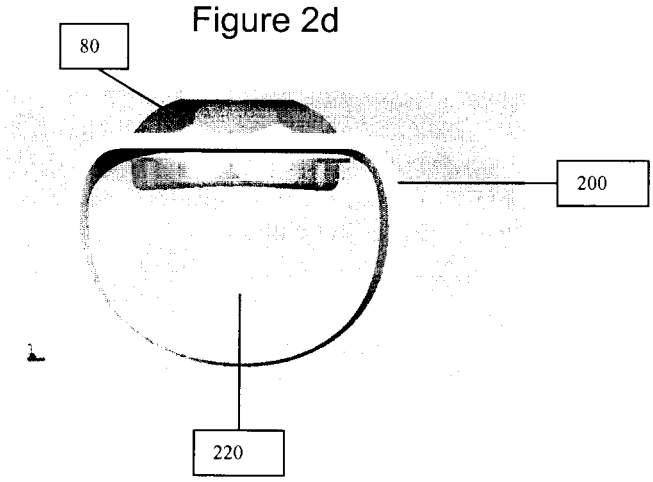
Figure 2E:
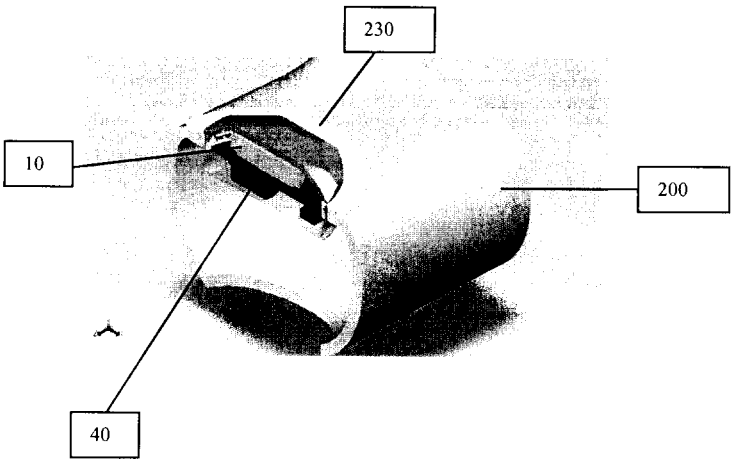

Another means for holding tag 10 in place on a body are seen in FIGS. 2*c* through 2*e*. In this embodiment sock 200, which may be a tubular knitted fabric sock made of densely knitted fabric. Sock 200 contains two apertures 210, 220. First aperture 210 receives tag 10 and second aperture 220 receives the body part. Ring 230 holds tag 10 in place. If sock 200 is removed from the person's body an alarm condition will be triggered as light sensor 20 will receive light and infrared sensor 30 will detect a change in infrared radiation as described below.

Infrared sensor 30 is used to detect a change in infrared radiation. The human body has a natural temperature which causes it to radiate energy in the infrared spectrum (typically 7 um to 14 um). When tag 10 is adjacent to a person's body the detected infrared radiation is constant or changes slowly. If tag 10 is removed from the patient, this infrared radiation level changes quickly, and this change is detected by infrared radiation sensor 30. This change in infrared radiation may be communicated by tag 10 as a tamper alarm condition. The pace of the infrared radiation change is important in determining if an alarm condition should be triggered. If the change is slow, a tamper alarm condition will not be declared. Tag 10 uses an algorithm to determine if the infrared radiation change is sufficient to trigger the tamper condition (e.g. someone removing tag 10 from the person or trying to defeat the sensor by sliding fingers under tag 10) or if the change in radiation is happening because the person is just moving normally, which causes tag 10 to move with the person.

Tag 10 is in an inactive (dormant) state while it is not on a person. When tag 10 is mounted on a person properly tag 10 becomes active. Tag 10 becomes active when infrared radiation sensor 30 senses a quick and significant change in infrared radiation (indicating tag 10 has been placed on a person's body). Within a predetermined time (e.g. 10 seconds) after initiation, light sensor 20 should be inactivated (indicating light sensor 20 has been covered by tag holder 120 and strap 190 (or sock 200 or wrap 195). If light sensor 20 is not inactivated in such time, the tag may not be activated, or an alarm condition may be initiated.

In an alternative embodiment of the invention, as seen in FIGS. 3 through 10, tag 15, for use on objects, includes power source 40, processor 50 and wireless network interface 60. Tag 15 also includes optical transmitter 100 and optical receiver 110, or as seen in FIG. 3*b* infrared transmitter 105 and infrared receiver 115 may be used in lieu of optical transmitters or receivers, in which case infrared transmitter 105 will transmit an infrared signal to infrared receiver 115. Tag 15 can use either visible and infrared light to detect tampering. If infrared transmitter 105/receiver 115 are used, such infrared receiver detects an absolute value of infrared radiation (whereas infrared sensor 30 in the alternative embodiment detects a change in infrared radiation). The use of infrared transmitter 105/receiver 115, rather than optical, may provide power savings.

Optical transmitter 100 (or infrared transmitter 105)/receiver 110 (or 115) may not be active all the time, but may be cycled at rates of once every few seconds to several transmissions a second to preserve power as controlled by processor 50 or timer 55.

Optical transmitter 100 (or infrared transmitter 105) and receiver 110 or 155 are paired, and enclosed within tag 15. Light (or infrared radiation) is transmitted from the optical transmitter 100 (or infrared transmitter 105) through transparent plastic enclosure 70 and reflected back from the object or person that tag 10 is attached to through enclosure 70, whereby it is detected by the optical receiver 110 (or infrared receiver 115). Each optical transmitter 100/receiver pair 110 (or infrared transmitter 105/receiver 115 pair) is arranged so that the optical (or infrared) signal transmitted by optical transmitter 100 (or infrared transmitter 105) will not be detected by optical receiver 110 (or infrared receiver 115) unless the optical signal (or infrared), is reflected off the object or person to which tag 10 is attached.

If the surface of the object or person that tag 15 is attached to is not sufficiently reflective, then a reflective label 260 may be adhered to the object to ensure that adequate light (or infrared signal) from optical transmitter 100 (or infrared transmitter 105) is reflected back to optical receiver 110 (or infrared receiver 115). Label 260 may be attached by double-sided adhesive tape to the object, so there is no separate attachment required between the reflective label and tag 15.

Figure 3A:
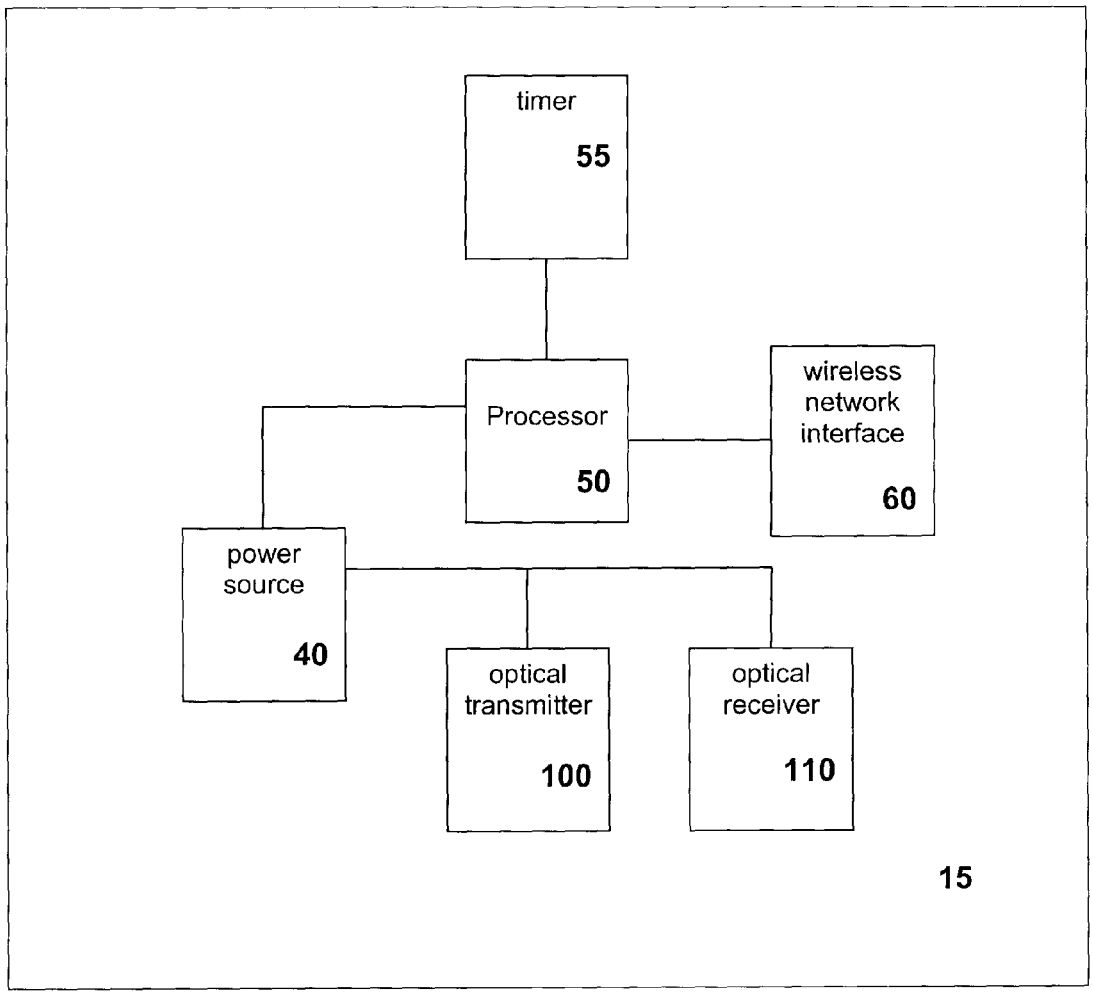
FIGS. 3*a* and 3*b* are block diagrams of alternative embodiments of a tag according to the invention.
Figure 3B:
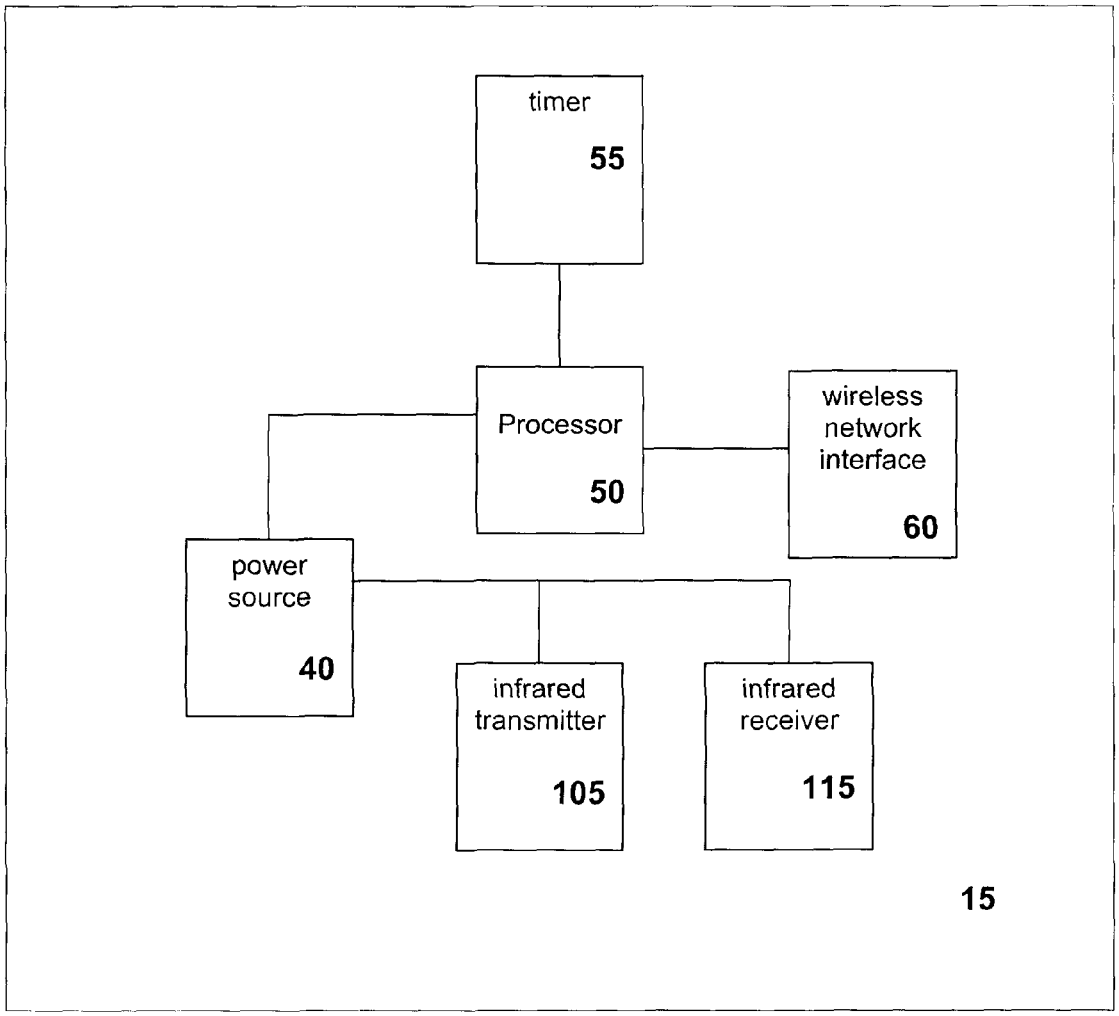
Figure 4:
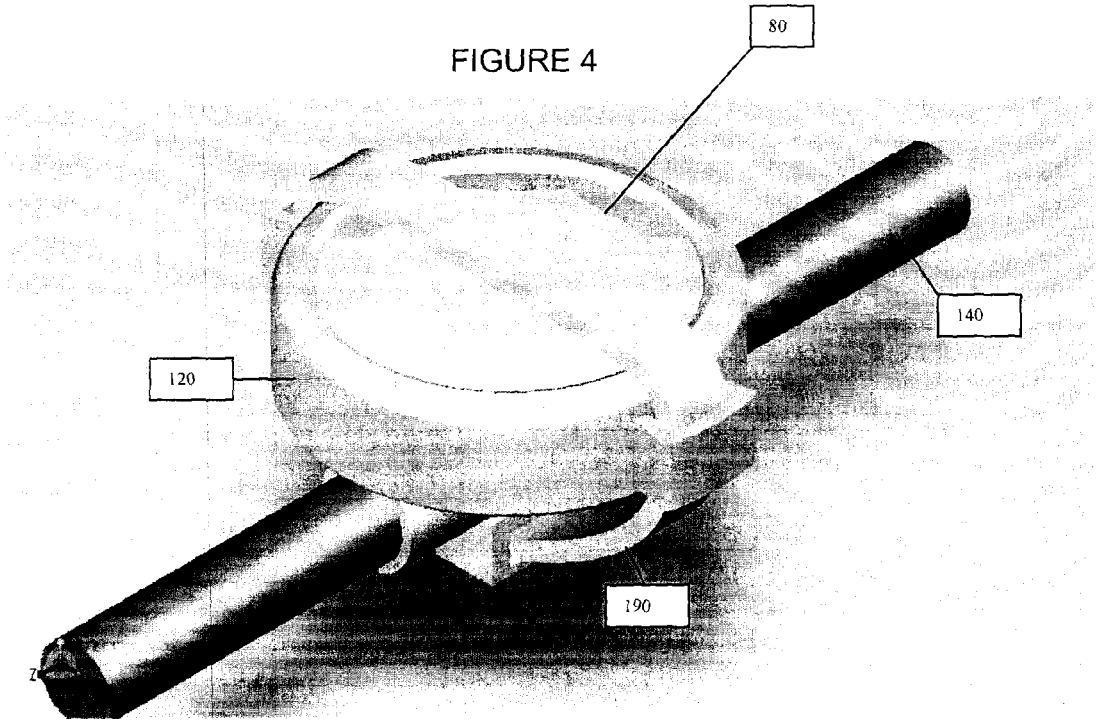
FIG. 4 is a perspective view of an embodiment thereof secured to an object using a tie wrap
Figure 5:
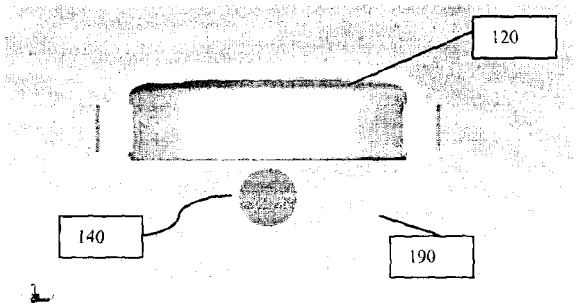
FIG. 5 is a front view thereof.
Figure 6:
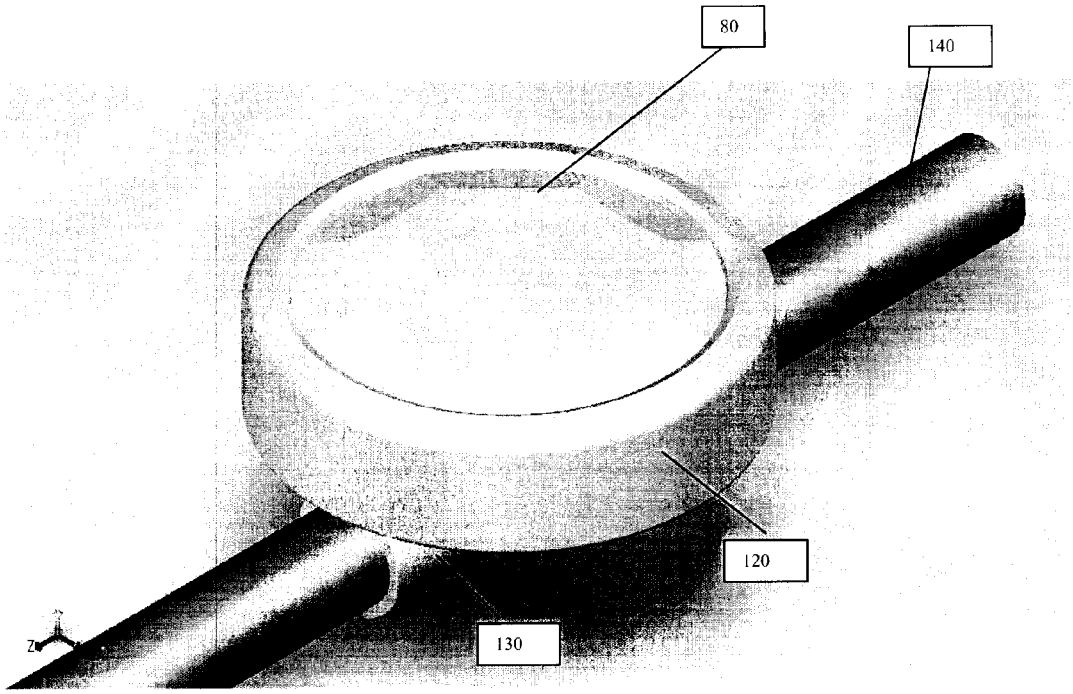
FIG. 6 is a perspective view thereof, secured to an object using adhesive.
Figure 7:
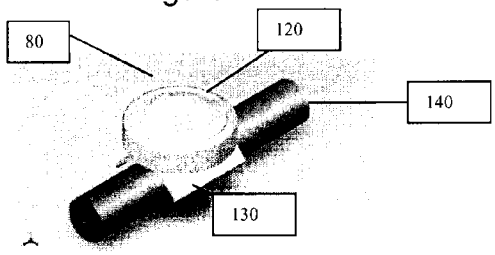
FIG. 7 is a perspective view of such embodiment, showing the tag secured to an object using adhesive.
Figure 8:
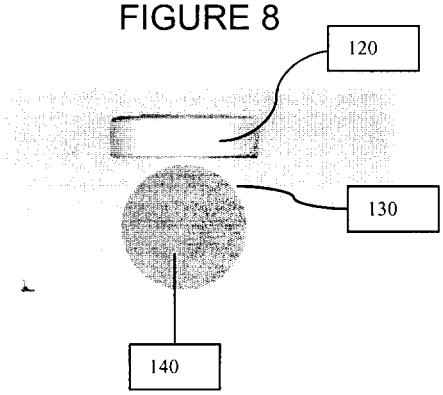
FIG. 8 is a front view thereof showing the tag secured to an object with a large circumference.
Figure 9:
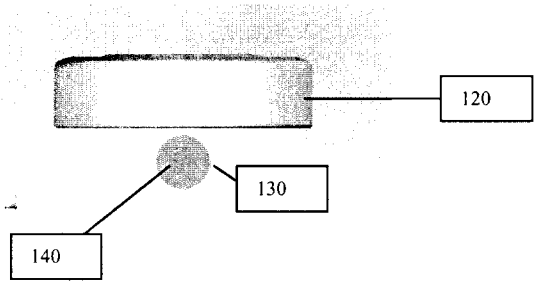
FIG. 9 is a front view thereof showing the tag secured to an object with a narrow circumference.

As seen in FIGS. 8 and 9 tag holder 120 provides successful mounting of tag 15 onto rounded surfaces of any diameter (poles, cables, etc.) while preserving tamper detection capability. Flaps 130 are made out of material such as rubber which allows flaps 130 to wrap around the surface of the object 140. Flaps 130 may be secured to object 140 with double-sided adhesive 150, as seen in FIG. 6, to ensure that tag holder 120 remains stationary, or by strap 190, as seen in FIGS. 3 and 4.

Figure 11:
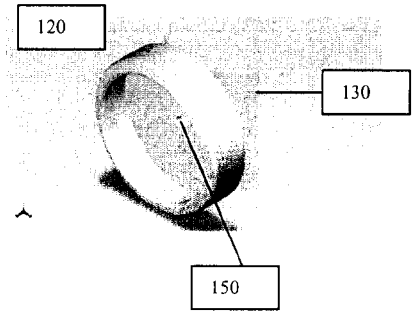
FIG. 11 is a view of the tag holder.

As seem in FIG. 11, tag holder 120 has aperture 150, preferably in middle, through which light (or the infrared signal) from optical transmitter 100 (or infrared transmitter 105) can pass and be reflected back from object 140 or the reflective label to optical receiver 110 (or infrared receiver 115). Light (or the infrared signal) from transmitter 100 (or 105) is reflected at an angle. This angle defines how far from the reflective surface the transmitter 100 (or 105)/receiver 110 (or 115) pair can be, which also defines the maximum thickness of enclosure 70. Aperture 150 size is also defined by this angle. Aperture 150 may be round or slot shaped.

Figure 10:
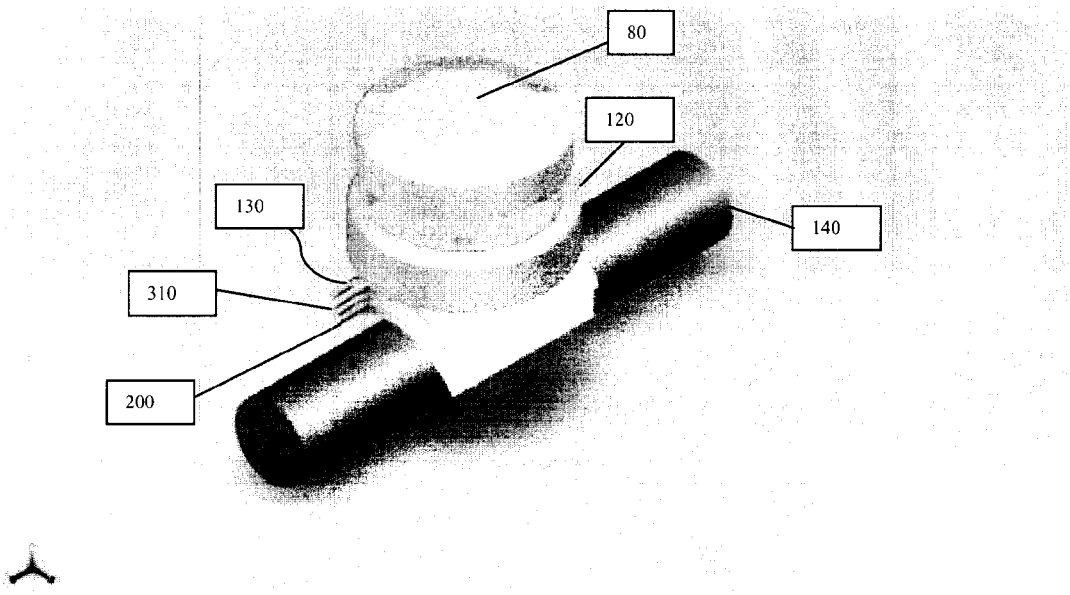
FIG. 10 is a perspective view thereof, showing the double sided tape, adhesive backing and reflective layer.

Reflective label 260 is part of tag holder 120 adhesive assembly, as seen in FIG. 10. The assembly is manufactured such that once tag holder 120 is secured to object 140, reflective label 260 is attached to object 140, but not tag holder 120. If label 260 was attached to tag holder 120, removing tag holder 120 (with tag 15) from object 140 would not trigger an alarm condition as the light or infrared signal would continue to be reflected by label 260.

Figure 14:
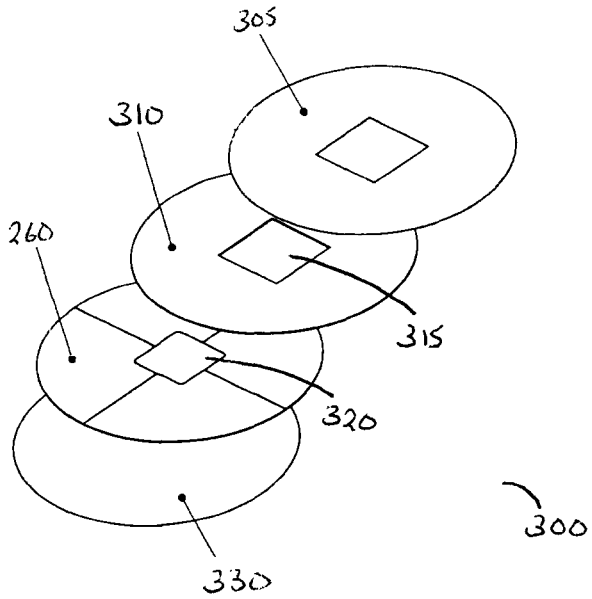
FIG. 14 is an exploded perspective view of an adhesive assembly according to the invention.
Figure 15:
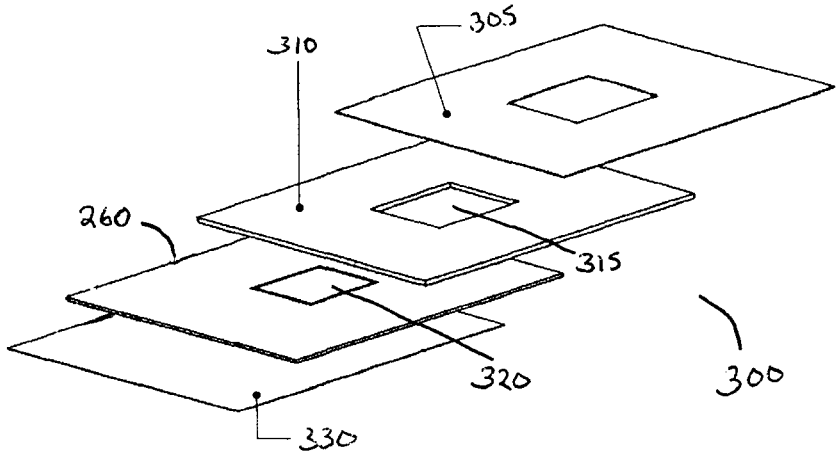
FIG. 15 is an exploded perspective view of an alternative embodiment thereof.

An adhesive assembly, as shown in FIGS. 14 and 15, may be used to provide that reflective label 260 is not removed along with tag 15 when tag 15 is removed from object 140. The assembly 300, as shown in FIG. 14 is for use with tag 15, when a tag holder 120 is not used, and the assembly 300, as shown in FIG. 15 is for use with tag 10 within tag holder 120. Adhesive assembly includes removable top and bottom liners 305 and 330, which are removed when tag 15 is secured to object 140. Double sided tape 310 contains aperture 315 for allowing signals to pass between object 140 or reflective label 260, and tag 15. Reflective label 260, which may be aluminium foil, includes indent 320 for receiving tag 15 and/or tag holder 120. Lower surface of reflective label 260 is also adhesive.

Specific embodiments have been shown and described herein. However, modifications and variations may occur to those skilled in the art. All such modifications and variations are believed to be within the scope and sphere of the present invention.

We claim:

1. An RFID tag, comprising:

a) a wireless network interface;

b) a processor;

c) a power supply; and d) a sensor sensitive to changes in radiation;

in which the RFID tag signals a tamper condition when the sensor senses a change in infrared radiation over a predetermined level as the RFID tag is removed from a radiating body, in which the sensor is sensitive to changes in visible light, wherein the RFID tag is covered by a light blocking material such that when the RFID tag is removed from the light blocking material, the light sensor is exposed to light and a tamper condition is signaled by the tag.

2. The tag of claim 1, further comprising a wrap to position the tag around a body part, wherein the RFID tag is covered by the light blocking material such that when the wrap is lifted away from the body part, or the RFID tag is removed from the body part, the light sensor is exposed to light and a tamper condition is signaled by the tag.

3. An RFID tag, comprising:

a) a wireless network interface;

b) a processor;

c) a power supply; and d) a sensor sensitive to changes in radiation;

in which the REID tag signals a tamper condition when the sensor senses a change in infrared radiation over a predetermined level as the RFID tag is removed from a radiating body, wherein the tag is positioned within a tag holder, the tag holder positioned within an elongated cylindrical sock, the sock positionablc around a body part.

4. An RFID tag, comprising:

a) a wireless network interface;

b) a processor;

c) a power supply; and d) a sensor sensitive to changes in radiation;

in which the RFID tag signals a tamper condition when the sensor senses a change in infrared radiation over a predetermined level as the RFID tag is removed from a radiating body, wherein the tag is inactive until placed on a person's body wherein the change in infrared radiation is detected by the infrared sensor and the tag is initiated.

5. The tag of claim 4 wherein the tag is activated after the tag is initiated and the an optical sensor does not detect light within a predetermined time period after initiation.

6. An RFID tag, comprising a wireless network interface;

a processor;

a power supply; and an optical transmitter paired with an optical receiver, wherein a tamper alarm is signaled by the RFID tag when the tag is moved from a surface that in normal operation reflects an optical signal from the transmitter to the receiver;

wherein the optical transmitter and optical receiver are not active unless activated by the processor;

further comprising a reflective label placed on an object to reflect light from the transmitter to the receiver.

7. The RFID tag of claim 6 wherein the tag is stored within a tag holder adhered to the reflective label.

8. The RFID tag of claim 6 wherein the object is curved, and the tag is mounted to the object using first and second flaps to adhere the tag to the object.

9. An RFID tag, comprising a wireless network interface;

a processor;

a power supply; and an infrared transmitter paired with an infrared receiver, wherein, when the infrared receiver does not receive an infrared signal emitted from the infrared transmitter at a predetermined level commensurate with the RFID tag remaining attached to a radiating body, a tamper alarm is signaled by the tag wherein the infrared transmitter and infrared receiver are not active unless activated by the processor or an independent timer;

further comprising a reflective label placed on an object to reflect an infrared signal from the infrared transmitter to the infrared receiver.

10. The RFID tag of claim 9 wherein the tag is stored within a tag holder adhered to the reflective label.

11. The RFID tag of claim 9 wherein the object is curved, and the tag is mounted to the object using first and second flaps to adhere the tag to the object.

* * * * *